US005484177A

United States Patent [19]

Fortune et al.

[11] Patent Number: 5,484,177

[45] Date of Patent: Jan. 16, 1996

[54] DUAL FUNCTION LOCK MECHANISM

[76] Inventors: Geoffrey J. Fortune, 10 Luckie Street, Nunawading, Victoria, 3132, Australia; Erwin R. O. Liebherr, deceased, late of Wonthaggi; by Helga L. A. Liebherr, executrix, 28 Matthew Street, Wonthaggi, Victoria, 3995, Australia

[21] Appl. No.: 131,954

[22] Filed: Oct. 8, 1993

(Under 37 CFR 1.47)

[30] Foreign Application Priority Data

| | | | |
|---|---|---|---|
| Oct. 9, 1992 | [AU] | Australia | PL5182 |
| Jan. 27, 1993 | [AU] | Australia | PL6948 |

[51] Int. Cl.[6] ..... E05C 1/06

[52] U.S. Cl. ..... 292/140; 292/359; 292/169

[58] Field of Search ..... 292/140, 169, 292/98, DIG. 30, DIG. 37, DIG. 41, 359

[56] References Cited

U.S. PATENT DOCUMENTS

| | | | |
|---|---|---|---|
| 2,218,183 | 10/1950 | Springer | 292/DIG. 37 |
| 3,471,188 | 10/1969 | Hawkins | 292/140 |
| 3,790,196 | 2/1974 | Sanders et al. | 292/140 |
| 3,896,645 | 7/1975 | Nagy et al. | 292/169 |
| 4,301,667 | 11/1981 | Best et al. | 292/140 |
| 4,594,864 | 6/1986 | Hart . | |
| 4,602,490 | 7/1986 | Glass et al. | 292/169 |
| 5,029,913 | 7/1991 | Wartian | 292/169 |

FOREIGN PATENT DOCUMENTS

| | | |
|---|---|---|
| 1439696 | 6/1976 | United Kingdom . |
| 2014641 | 8/1979 | United Kingdom . |
| 511,483 | 4/1955 | Canada . |

*Primary Examiner*—Peter M. Cuomo
*Assistant Examiner*—Monica E. Millner
*Attorney, Agent, or Firm*—Sughrue, Mion, Zinn, Macpeak & Seas

[57] ABSTRACT

A dual function lock mechanism includes a body (30,32), and a cam member (34) mounted on the body for rotation about an axis. A retractor (36) is adapted to drive a latch bolt and is supported for sliding movement transversely with respect to the axis. Means is provided to slide the retractor in a first direction to retract the latch bolt from a latch position to a release position. By virtue of respective cooperable mutually engageable formations (41,72) on the cam member and on the retractor means, a predetermined first rotational movement of the cam member is effective to slide the retractor in a direction opposite the said first direction to move the latch bolt from the latch position to an extended lock position, and a predetermined opposite rotational movement is effective to return the latch bolt from the lock position to the latch position. Detent means (64) is provided to engage and thereby normally prevent the retractor from moving the latch bolt from the lock position to the latch position. The retractor is so supported and the formations are so cooperable that, to allow movement of the latch bolt from the lock to the latch positions, at least one of the retractor and the detent means is displaceable by the cam member in a direction angled to the direction of the sliding movement whereby to disengage the retractor from the detent.

17 Claims, 14 Drawing Sheets

DUAL FUNCTION LOCK MECHANISM

BACKGROUND OF THE INVENTION

This invention relates to a lock mechanism and in some aspects to a dual function lock mechanism. In another aspect, the invention relates to a privacy lock assembly.

It is common practice to fit doors with separate latch bolt and deadlock fittings. The latch bolt is typically handle actuated, while the deadbolt is usually associated with a conventional double-cylinder deadlock for key release or engagement from either side of the door.

It is also known to provide deadlock mechanisms in which the deadbolt has an angled rather than rectangular tip, and may be projected to an extended lock position when a contact pin or auxiliary bolt is retracted by engagement with the strike plate of the door jamb. Such a mechanism is shown, for example, in Australian patent 540386. A commonly used form of this type of mechanism provides for the bolt to be key locked in the extended position from the inside of the door. These mechanisms are generally mounted on a housing on the inside face of the door and are not readily adaptable for use with high quality door knobs. They also have the disadvantage that, when a person uses the key to open the door from the outside, the inside key cylinder must be separately unlocked or the door will remain totally deadlocked when it is shut behind the entering person. This is not necessarily desirable from a safety point-of-view.

Various combination latch and deadbolt mortice lock mechanisms are known but these require the provision of a very substantial rectangular cavity in the body of the door.

SUMMARY OF THE INVENTION

It is an object of the present invention, in one of its aspects, to provide a dual function lock mechanism which can be adapted to fit a standard door latch/lock cavity incorporating a transverse round hole, eg of about 54 mm diameter and an intersecting bore for the bore casing. By a dual function lock mechanism is meant that there is a single bolt which may be selectively set as a simple latch or in a longer throw lock position.

The invention accordingly provides, in its first aspect, a lock mechanism comprising:

a body;

a cam member mounted on the body for rotation about an axis;

retractor means adapted to drive a latch bolt and supported for sliding movement transversely with respect to said axis;

means to slide the retractor means in a first direction to retract the latch bolt from a latch position to a release position;

respective cooperable mutually engageable formations on the cam member and on the retractor means whereby a predetermined first rotational movement of the cam member is effective to slide the retractor means in a direction opposite the said first direction to move the latch bolt from said latch position to an extended lock position, and a predetermined opposite rotational movement is effective to return the latch bolt from the lock position to the latch position; and detent means to engage and thereby normally prevent said retractor means from moving said latch bolt from said lock position to said latch position;

wherein said retractor means is so supported and said formations are so cooperable that, to allow movement of said latch bolt from the lock to the latch position, at least one of the retractor means and the detent means is displaceable by the cam member in a direction angled to the direction of said sliding movement whereby to disengage the retractor means from said detent means.

In one embodiment, the detent means normally prevents said retractor means from moving between said latch and lock positions, and said retractor means is so supported and said formations are so cooperable that, to allow movement of said latch bolt between the latch and lock positions, the retractor means is displaceable by the cam member in a direction angled to the direction of said sliding movement whereby to disengage the retractor means from said detent means.

The retractor means is preferably pivotally attached to a latch bolt or to a latch bolt assembly, whereby said displacement comprises a pivotable movement.

Advantageously, the retractor means includes plate means. There may typically be a pair of said cam members actuable from opposite sides of a door when the lock is in situ. The plate means preferably slides between these cam members, and there may then be separate said formations on opposite sides of the plate means operably associated with the respective cam members.

In another embodiment, the detent means comprises a moveable catch biased into engagement with a detent surface when the latchbolt is in said lock position to prevent return of the latchbolt to the latch position by force on the latchbolt, and said catch is moveable against said bias, in response to said first and opposite rotational movements of the cam member, out of said engagement with the detent surface.

Preferably, the catch is pivotably mounted on the retractor so that it is rotated clear of said detent surface by being engaged and rotatably moved by the cam member during said predetermined first and opposite rotational movements of the cam member.

Respective biasing means are preferably provided for biasing the retractor means from the release position to the latch position, and for biasing the retractor means into engagement with the detent means at said latch and lock positions. The latter biasing means may be a single compression spring captive between respective faces on the retractor means and the latch bolt. The retractor means preferably extends into a slot at the inner end of the latch bolt in which said pivotal attachment is provided.

The cam member preferably includes a suitably shaped radially projecting wing or lug, for example on an annular or disc member.

The detent means may include separate lands for engaging the retractor means at separate positions corresponding to the latch and lock positions of the latch bolt. More simply, it may comprise respective surfaces at opposite ends of a single lug or land forming part of or attached to the body.

The mechanism may include key actuated lock means, for example a cylinder lock, associated with the cam member, or with each or one of the cam members. The means to slide the retractor means in the first direction to retract the latch bolt from the latch position to the release position may function by way of the or each cam member. Alternatively or additionally, provision may be made to retract the latch bolt by means of a latch operator mechanism including a hand operator on a separate spindle from that or those mounting the cam member(s). In this case, the latch operator mechanism may include a crank with a recess or seat which receives an element of the retractor means, wherein that element and the crank are not operably engageable in the lock position of the latch bolt. In a typical fitting of the mechanism in a door, such a hand operator and a key lock associated with said cam member may be exposed to the interior of the door, while at the exterior there would be a second key lock associated with another said cam member.

In a second aspect, the invention provides a lock mechanism comprising:

a body;

a movable cam member mounted on the body;

retractor means adapted to drive a latch bolt and supported for sliding movement transversely with respect to said axis in response to movement of the cam member;

key actuated lock means associated with the cam member for locking the retractor means against said sliding movement;

hand operator means rotatable from either side of a door in situ, on an axis offset from said key actuated lock means, for sliding the retractor means in a first direction to retract the latch bolt from a latch position to a release position, when the retractor means is not locked by said lock means; and an automatically releasably privacy snib mechanism associated with said hand operator means.

The lock mechanism according to the second aspect of the invention may include any one or more of the aforedescribed preferred or optional feature of the first aspect, and may be provided in combination with the first aspect of the invention.

In a third aspect, the invention provides a privacy lock assembly comprising:

body;

respective spindle means each adapted to mount a manual door latch operator and each fitted with a respective rotary member rotatable with the spindle means, which spindle means are arranged so that one operator may be disposed on the same side of a door panel as the rotary members with the other operator on the other side of the door panel;

means for drivingly coupling a first of said rotary members, which is further from the door panel than a second of the rotary members, to a latch mechanism offset from said privacy lock assembly;

respective mutually co-operable first formations on said rotary members whereby a prescribed rotation of the second rotary member is effective to rotate the first rotary member;

a snib member including a finger engageable element whereby the snib member is movable from a freeing position to a snibbing position in which said inner second rotary member is located against rotation; and respective mutually co-operable second formations on the first rotary member and on the snib member whereby rotation of the first rotary member to operate said latch mechanism is effective to automatically release the snib member for said snibbing position.

The third aspect of the invention may advantageously be provided in combination with the first and/or second aspects.

In the third aspect of the invention, the second rotary member preferably comprises a plate having a centre disc portion and a pair of peripherally disposed, preferably diametrically opposite, lobes. The second rotary member is preferably locked in said snibbing position by engaging a lug on the snib member with one of these lobes while a further lug on the first rotary member, comprising one of said first formations, engages the other lobe.

Advantageously, the second rotary member may be mounted at selective angular positions relative to the first rotary member which per se define respective directions of said prescribed rotation of the operator on the other side of the door.

BRIEF DESCRIPTION OF THE DRAWINGS

The invention will now be further described, by way of example only, with reference to the accompanying drawings, in which.

DETAILED DESCRIPTION OF THE INVENTION

Figure 1:
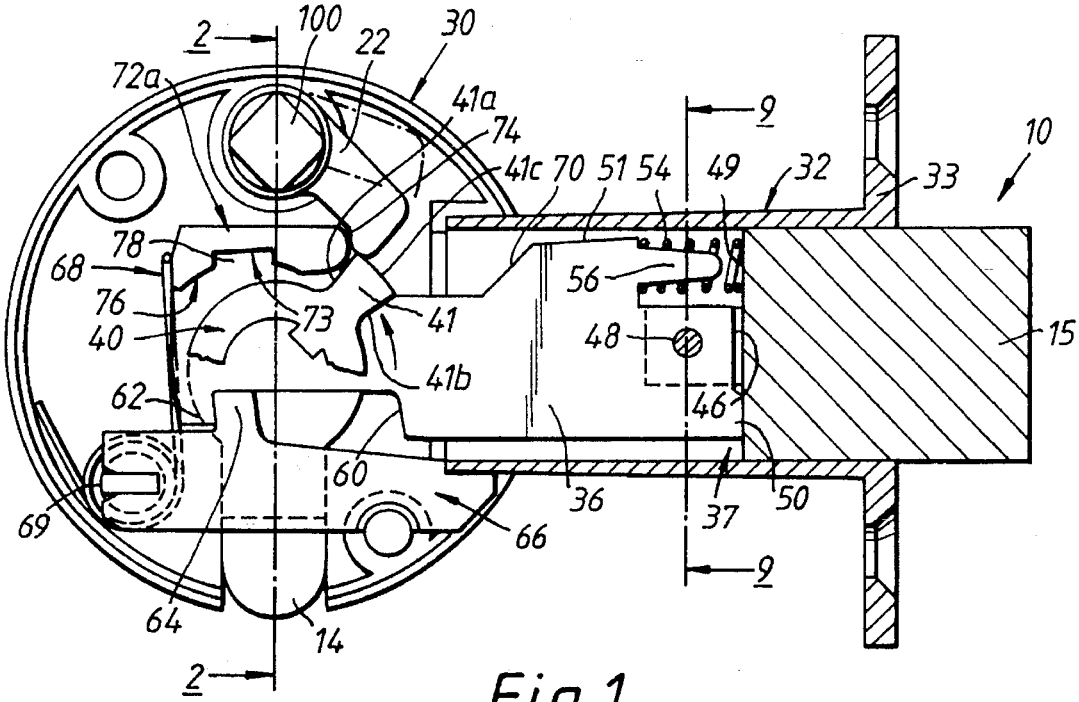
FIG. 1 is a somewhat diagrammatic cross-sectional view of a dual function lock assembly including a mechanism comprising a first principal embodiment according to the first aspect of the invention, taken on the vertical plane at the centre line of the latch bolt, and showing the latch bolt in its latch position.
Figure 2:
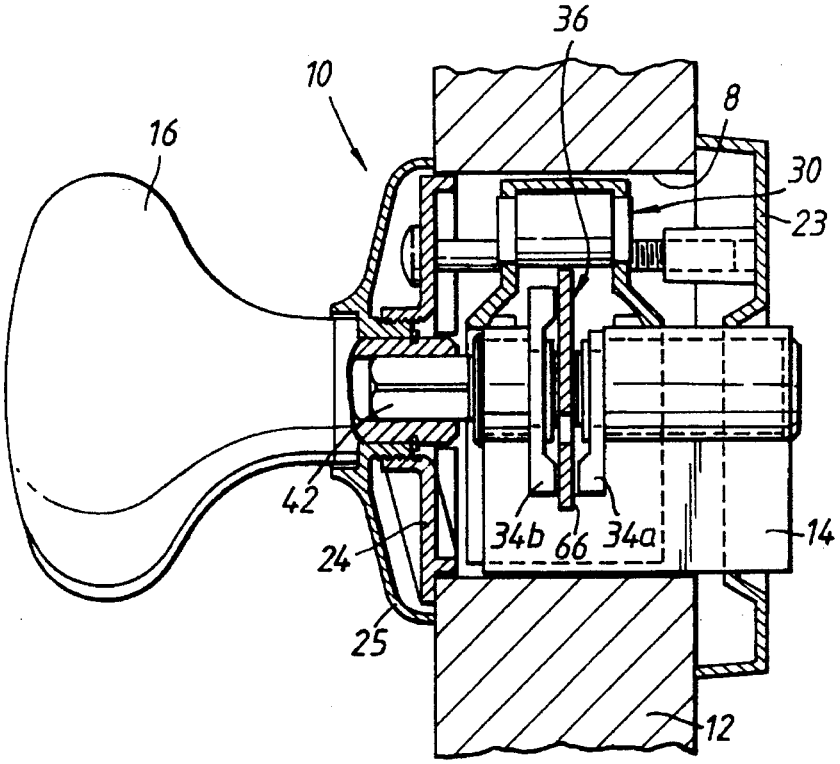
FIG. 2 is a cross-section on the line 2—2 in FIG. 1, ie at the vertical plane containing the common axis of the main operator spindles.
Figure 3:
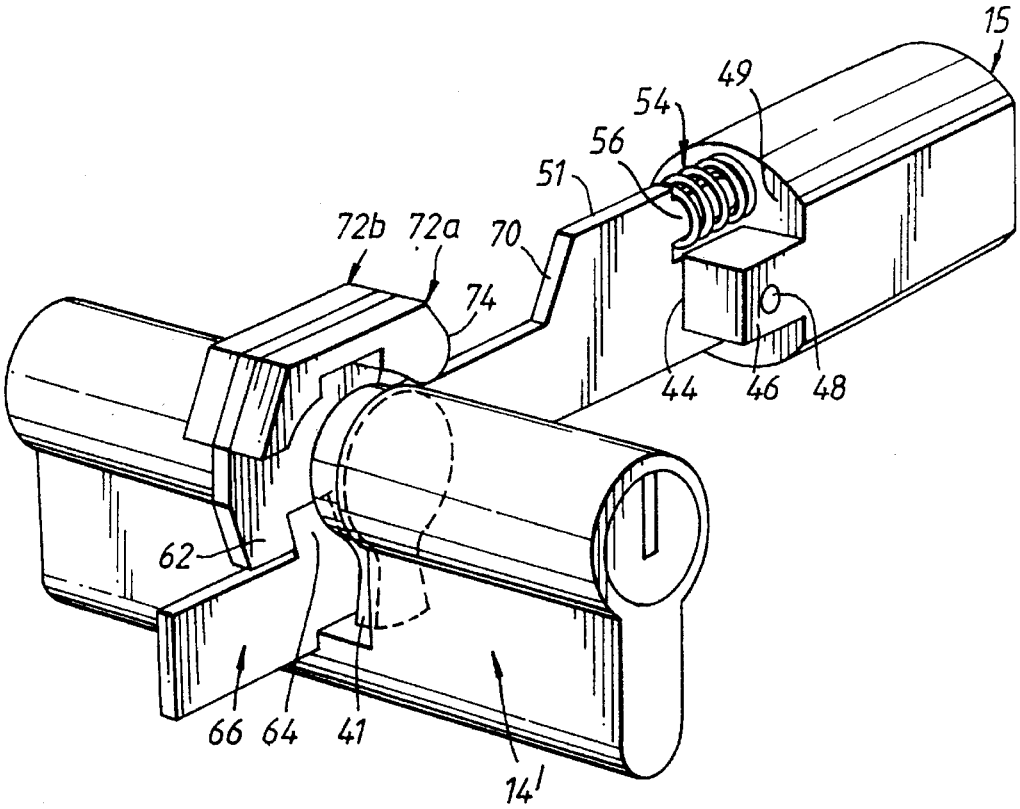
FIG. 3 is a fragmentary isometric sketch view of a slightly modified embodiment, depicting the relative arrangements of the latch bolt, centre retractor plate, index lever and a dual cylinder lock.

The illustrated dual function lock assembly 10 depicted, with variations, in FIGS. 1 to 15 is shown mounted to a door leaf 12 and is depicted in somewhat diagrammatic form with some of the detail of external components omitted for sake of clarity. The assembly includes a latch bolt 15, a cylinder key lock 14 operable from the outside of the door, and a manual knob operator 16 for operation from the inside of the door. The assembly is further provided with the usual external facilities such as a face plate 23 to position cylinder lock 14, and a mounting set for knob 16 including threadably interengaged backing plate 24 and escutcheon 25. The latter provides a bearing for knob 16.

The usual cavities in the door leaf seat a main body or housing 30 and a latch bolt casing 32. The cavity for main housing 30 is a standard cylindrical bore 8, eg of 54 mm diameter, and the ability to mount the mechanism within such a standard cylindrical bore is an advantage of the preferred embodiments of the mechanism. Main housing 30 is a two-part cast assembly embracing the cylinder lock 14, respective cam members 34*a*,34*b* associated with the cylinder lock and with the knob operator 16, retractor means in the form of a slidable centre retractor plate 36 forming a sub-assembly 37 with latch bolt 15, and a crank 22. Crank 22 shown in FIGS. 1, 4, 5 and 6 forms part of an alternative latch operator mechanism described later in connection with FIGS. 11 and 12 and is not required in the lock assembly shown in FIG. 2. Although in the embodiment of FIGS. 1, 2 and 4 to 9, crank 22 is not operational, it is provided as a standard component so that the mechanism is adaptable to a variety of alternative configurations.

Latch bolt casing 32 provides a close sliding fit for latch bolt 15 and has an integral external facing plate 33 on the edge of the door. Latch bolt 15 would engage the normal strike plate and cavity (not shown) on the door jamb. For this purpose, the latch bolt has the usual angled face to allow automatic retraction from the latch position when the door is closed.

Latch bolt/retractor sub-assembly 37, and accordingly latch bolt 15, have three operating positions: a retracted or release position (FIG. 4) in which the latch bolt is retracted into casing 32 to allow the door to be opened; an intermediate-throw latch position (FIG. 1) in which the latch bolt is readily retracted to the release position by simply turning the handle of latch operator mechanism 16, or by using the key in cylinder lock 14, and an extended throw lock position in which greater security is afforded by setting the latch bolt in a "deadlock" position.

Each cam member 34*a*,34*b* is of a conventional type comprising an annular member or ring 40 and one or more integral projecting wings 41 defined between respective radial edges 41*a*,41*b* and an outer arcuate edge 41*c* concentric with the ring. Cam member 34*a* is coupled to the key released spindle of cylinder lock 14, while cam member 34*b* rotates with a square spindle 42 splined in a blind bore of knob 16.

Centre retractor plate 36 is positioned to reciprocate centrally between the opposed, spaced faces of cam members 34*a*,34*b*. At its forward end, plate 36 extends into a slot 44 defined between two rear rectangular lugs 46 of the latch bolt, and is pivoted to the latch bolt on a transversely extending point 48. The angular range of pivotal movement of plate 36 is quite small: the lowered position is determined by a lug 50 at the rear corner of the plate striking the main rear face 49 of latch bolt 15 (FIG. 1), while the upper limit is determined by engagement between a slightly inclined upper edge 51 of the plate with the interior surface of latch bolt casing 32. The plate is biased to the lower position by a helical compression spring 54 mounted about a rearwardly projecting tapered spring post 56 on plate 36, between the rear face 49 of the latch bolt and stop surfaces at the base of post 56.

Figure 9:
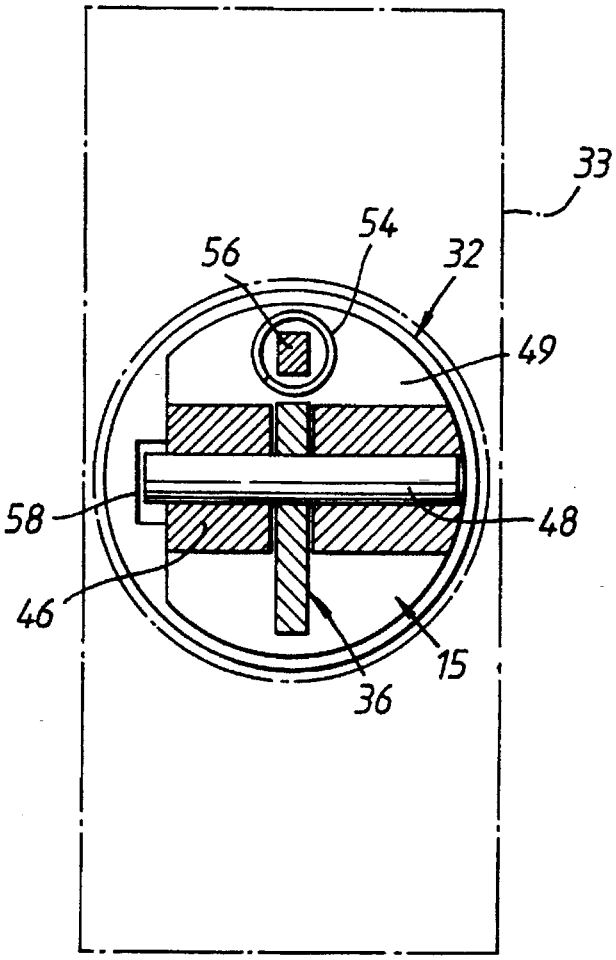
FIG. 9 is a cross-section on the line 9—9 in FIG. 1.

As best seen in FIG. 9, pivot pin 48 projects at one side into a guide slot 58 in the side wall of latch bolt casing 32. This slot defines the limits of travel of sub-assembly 37 and also retains the sub-assembly in the latch bolt casing.

Towards its rear end, retractor plate 36 has a bight 60 in its lower edge which serves to define a depending lug 62 at the bottom rear corner of the plate. The intermediate latch position of the assembly is defined by the engagement of this lug 62 behind a complementary upstanding lug 64 on an index plate 66 retained in main housing 30 under and coplanar with the retractor plate 36. It will thus be appreciated that index plate 66 also extends between cam members 34*a*, 34*b*. The whole assembly 37 is biased to this intermediate latch position by a generally upstanding inverted-U shaped spring 68 which engages behind the upper rear edge of plate 36. This spring has respective terminal coils 69 by which it is mounted to either side of index plate 66; this shape allows plate 36 to pass between the arms of the spring, a requirement which will become better understood subsequently.

The upper edge of retractor plate 36 has a more centrally located bight 70 and behind this bight 70 each side of the plate is fitted with a respective outstanding land 72*a*,72*b*. These lands are substantially identical and define a lower edge 73 of somewhat complex shape which interacts with the or each respective wing 41 of cam members 34*a*,34*b*. Successive features of this shape will now be described in turn with reference to the operational movements of the assembly.

The forward edge of each land 72*a*,72*b* provides a rounded nose 74. The position of each nose is such that, when the assembly 37 is in its intermediate latch position, the respective cam member can be rotated to bring the wing 41 into engagement with the nose 74 (the position actually shown in FIG. 1). Further rotation of the cam member will cause the wing 41 to push the land 72 and thereby drive the retractor plate 36, and hence the latch bolt 15, against spring 68 back towards the rear wall of main casing 30. The rearward limit is the release position shown in FIG. 4 and it will be seen that the latch bolt 15 has thereby been withdrawn into latch bolt casing 32, and the door unlatched.

If the cam member is now turned back over 90° the other way, spring 68 will ensure prompt return of the assembly 37 to the intermediate latch position shown in FIG. 1.

Figure 5:
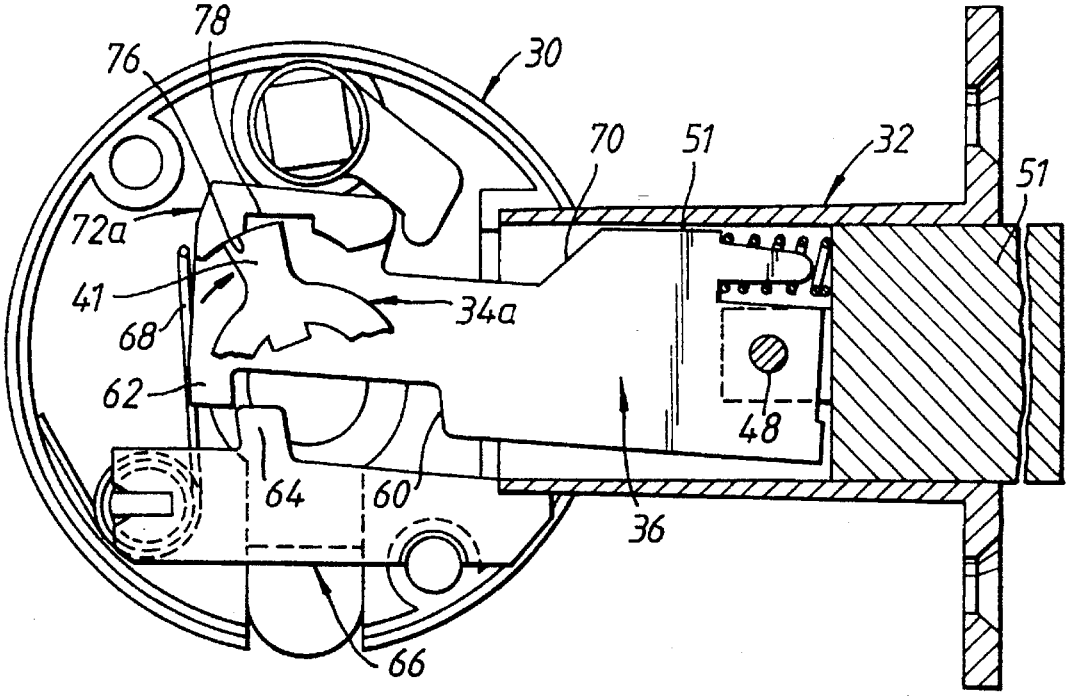
FIGS. 5, 6 and 7 are views similar to FIGS. 1 and 4 but show the assembly at successive stages during its movement of the lock position.

If the cam member 34*a* or 34*b* is rotated in a clockwise direction, it will engage a rear inclined portion 76 of the lower edge of land 72. Further rotation of the wing 41 will cause the wing to if the land 72, and thereby pivotably lift plate 36 until lug 62 is cleared from behind lug 64 and wing 41 can move further in under the edge 73, as shown in FIG. 5. Wing 41 can now seat in a rectangular recess 78 of edge 73 until its strikes the forward vertically depending boundary 80 of recess 78. Further rotational movement of the cam member will now drive land 72 and therefore the whole of assembly 37 forwardly until lug 62 is cleared over and past lug 64. This is the position shown in FIG. 6. It will be seen that recess 78 must be of sufficient length to accommodate the changing relative configuration of wing 41 during this segment of the motion. At this forward position, edge 72 is concavedly chamfered at 82 to allow wing 41 to move forwardly out of recess 78 and to commence its downward movement. Initially as it does so, spring 54 biases retractor plate 36 pivotally downwardly to drop lug 62 in front of lug 64 (FIG. 7). Cam member 34a,34b can freely return to the bottom-most position for retraction of the key. The latch bolt is now in an extended deadlocked position, in which it cannot be forced back because of the positive engagement of lug 62 against lug 64.

Figure 4:
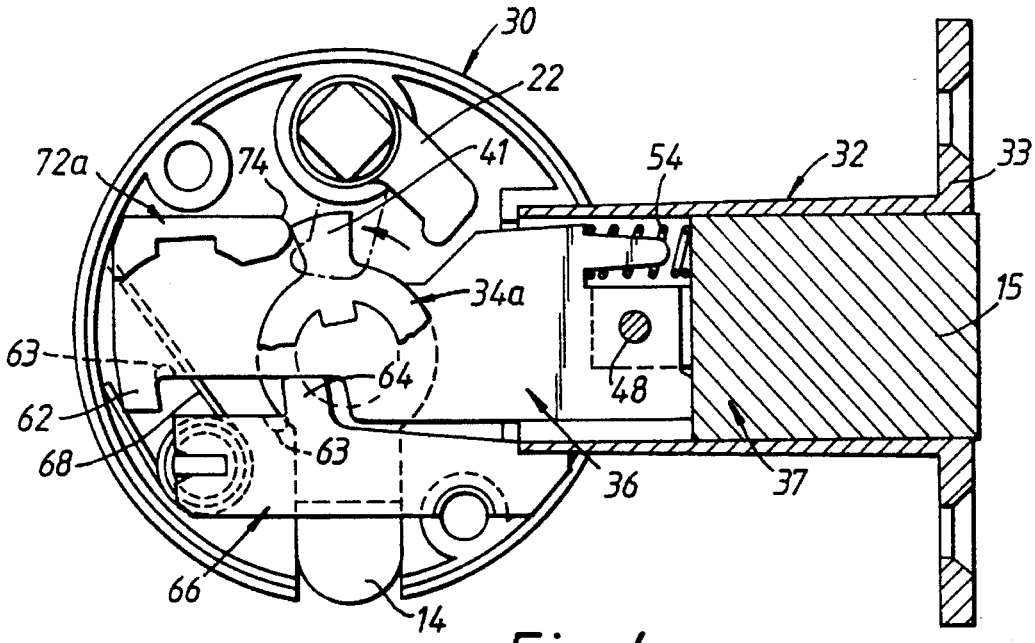
FIG. 4 is a view similar to FIG. 1 but showing the latch bolt in its door release position.

To facilitate the disengagement of lug 62 from behind lug 64, curved notches may be provided adjacent each lug, in retractor plate 36 and index plate 66 as depicted at 63 in FIG. 4.

Figure 6:
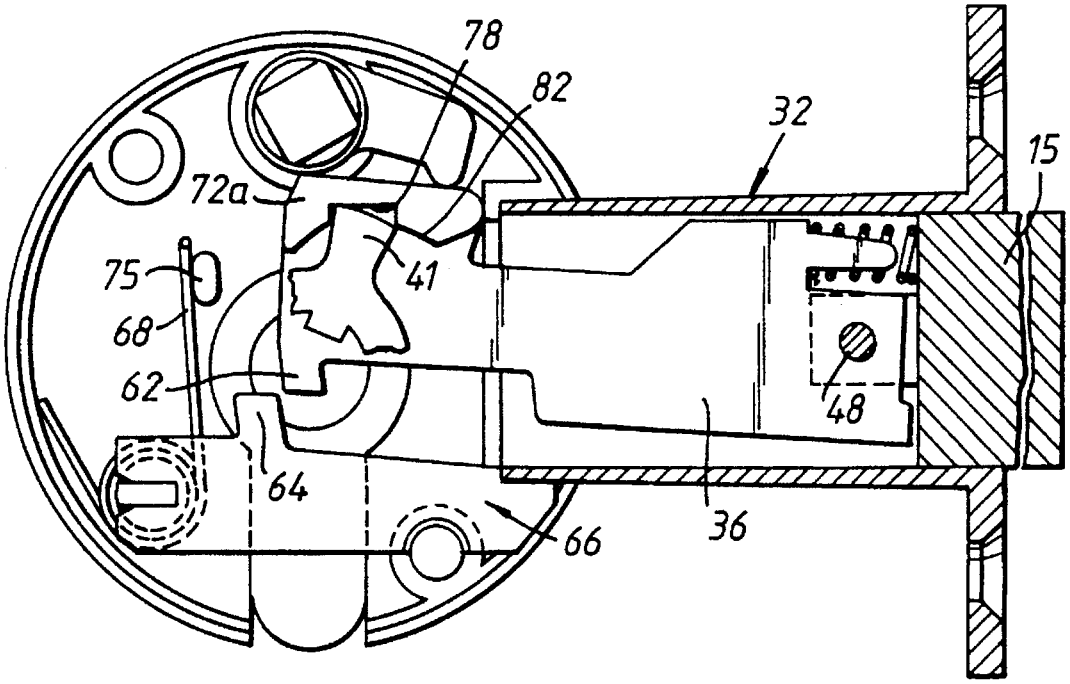
Figure 7:
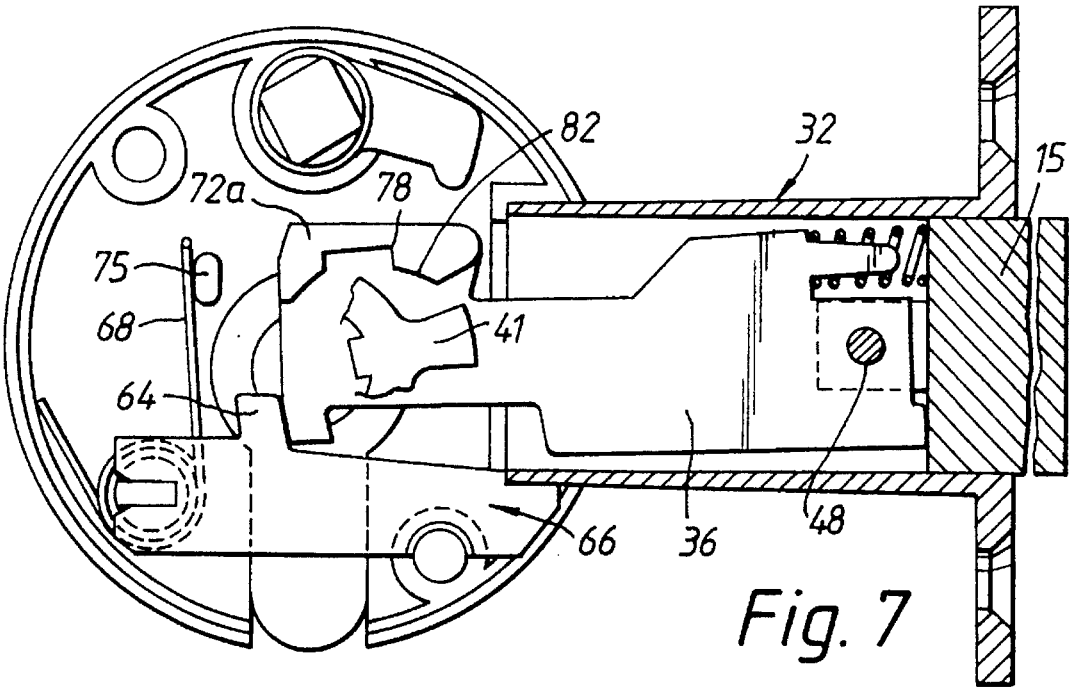

It will be appreciated from an inspection of FIGS. 6 and 5 that the just described motion is reversible. If cam members 34a,34b is rotated anti-clockwise from a bottom position, the wing 41 will strike the forward end segment 84 of edge 73 behind nose 74 (which is itself now too far forward to be struck by the wing). The wing will then again lift land 72, and therefore retractor plate 36 up to clear lug 62 from in front of lug 64. At this point, the position of FIG. 6 will have been again reached and further anti-clockwise movement of wing 41 will force land 72 and therefore subassembly 37 back to the position of FIG. 5, whereupon again spring 54 will cause lug 62 to drop behind lug 62 as the wing is cleared away from land 72.

It should be noted that at the intermediate latch position of assembly 37, main spring 68 strikes a stop 75 (FIG. 6) on the side wall of main cavity 30 so that, during the action of lifting retractor plate 36 to clear lug 62 from behind lug 64, the spring is not acting on the plate. This provision helps avoid the risk of jamming which might otherwise occur if the spring were still acting on the plate.

Figure 8:
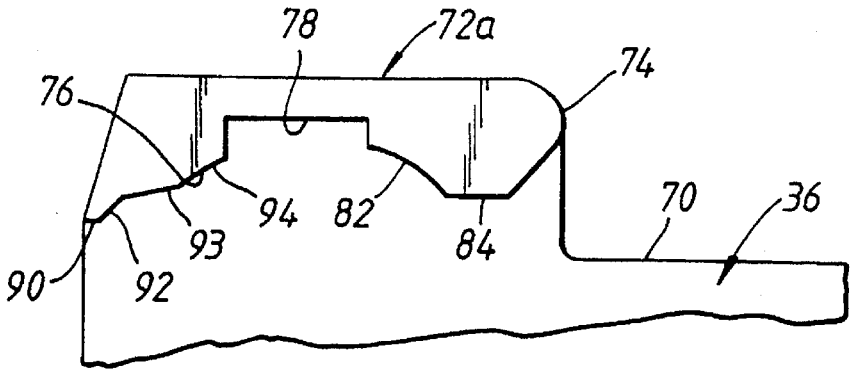
FIG. 8 is an enlarged elevational view of a segment of the retractor plate, but showing a modified shape for part of the retractor plate.

To further reduce the risk of jamming a modified shape of rear portion 76 of edge 73 may be provided as detailed in the enlarged view of FIG. 8. It will be seen that edge portion 76 has a rear small horizontal segment 90 which is first struck by the forward corner of wing 41 to commence the lift, a second small segment 92 approximately complementary to the shape of the outer arcuate edge 41c of the wing, a third inwardly angled portion 93, and a fourth segment 94 which is curved to complement the arcuate edge 41c of the wing. The angle between segments 92,93 provides a seat for the corner of the wing which assists in holding retractor plate 36 against any tendency to move forward as it is lifted; such forward movement would cause increased pressure between lug 62,64 and might thereby cause jamming. Segment 94 rides smoothly along the arcuate edge of the wing as it passes, although at this point there is no serious difficulty if the retractor plate begins to move forward, since lug 62 has now cleared from behind lug 64.

It may be necessary to provide similar features of shape along edge segments 82,84.

As already explained, crank 22 is shown in FIGS. 1 and 4 to 7 but is not an operational part of these embodiments. However, it forms an operational component of an alternative embodiment depicted in FIGS. 11 and 12. In this case, the respective cam members 34a',34b' are both operated by cylinder locks and indeed FIG. 3 applies to this embodiment and shows a standard double cylinder lock for this purpose. In this case, the deadlocking function is enhanced by providing for key locking from both sides of the door and the latching function is controlled by a separate knob operator 16' provides on another axis. A useful feature of this embodiment is that, while the latch bolt may be moved to the deadlocked position by key actuation from either side of the door, is not necessary for a person to unlock both sides for the deadlocked position to be fully released.

Figure 10:
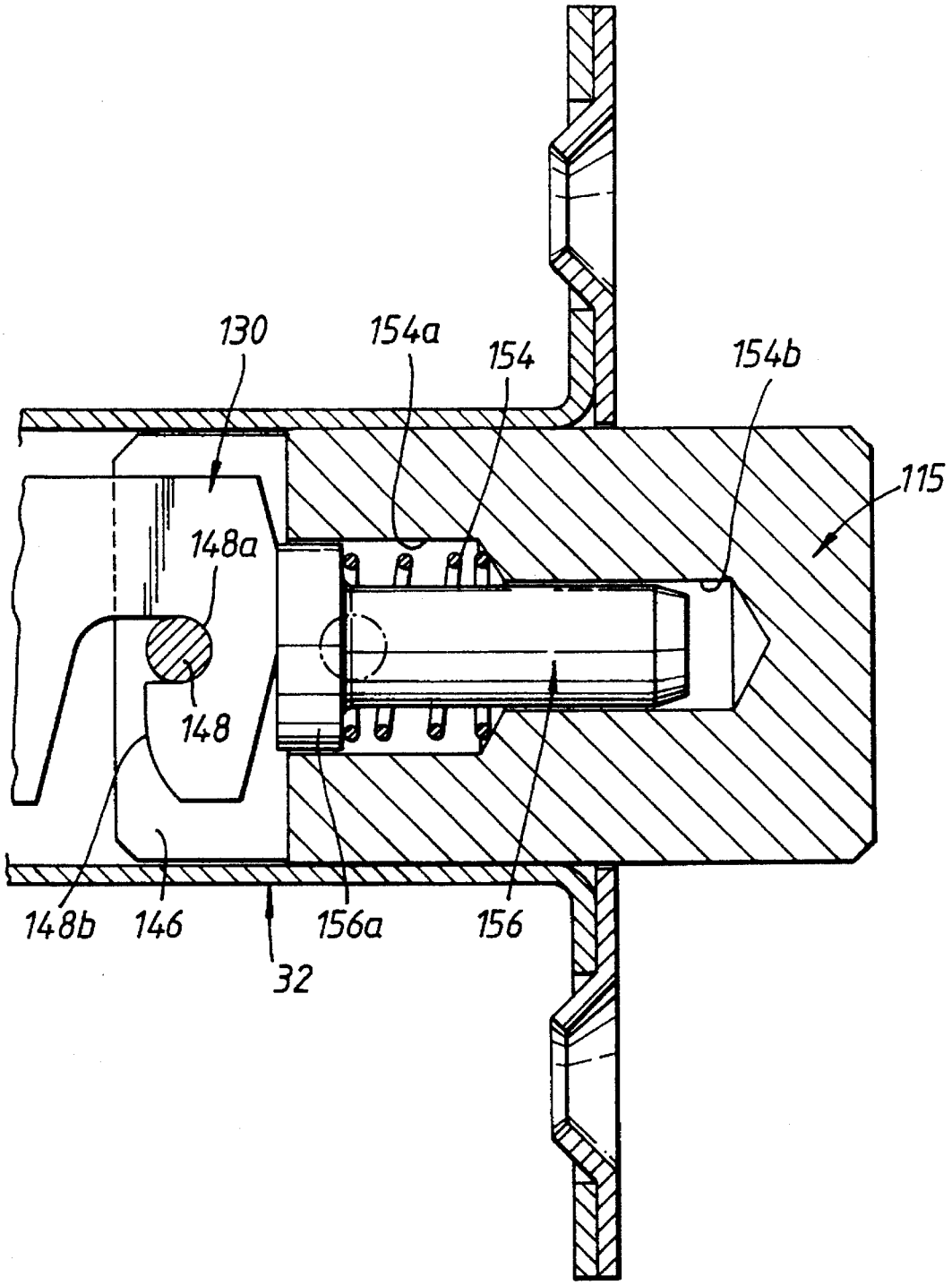
FIG. 10 shows an alternative arrangement for coupling the retractor plate to the bolt.

FIG. 10 shows an alternative arrangement for coupling retractor plate 136 to latch bolt 115. In this case, pivot pin 148 is fixed between lugs 146 of the latch bolt and locates in a complementary rounded side notch 148a at the end of a slot 148b in plate 136 shaped so the plate can be readily engaged with the pin, and therefore with the latch bolt 115, by hooking the plate about the pin. In this case, spring 154 is provided in a countebored outer portion 154a of a blind bore 154b in the rear of latch bolt 115. The spring acts between a shoulder defined by the counterbore and the head 156a of a stud 156 disposed in the blind bore. Stud head 156a is biased by the spring against the end of retractor plate 136.

Figure 11:
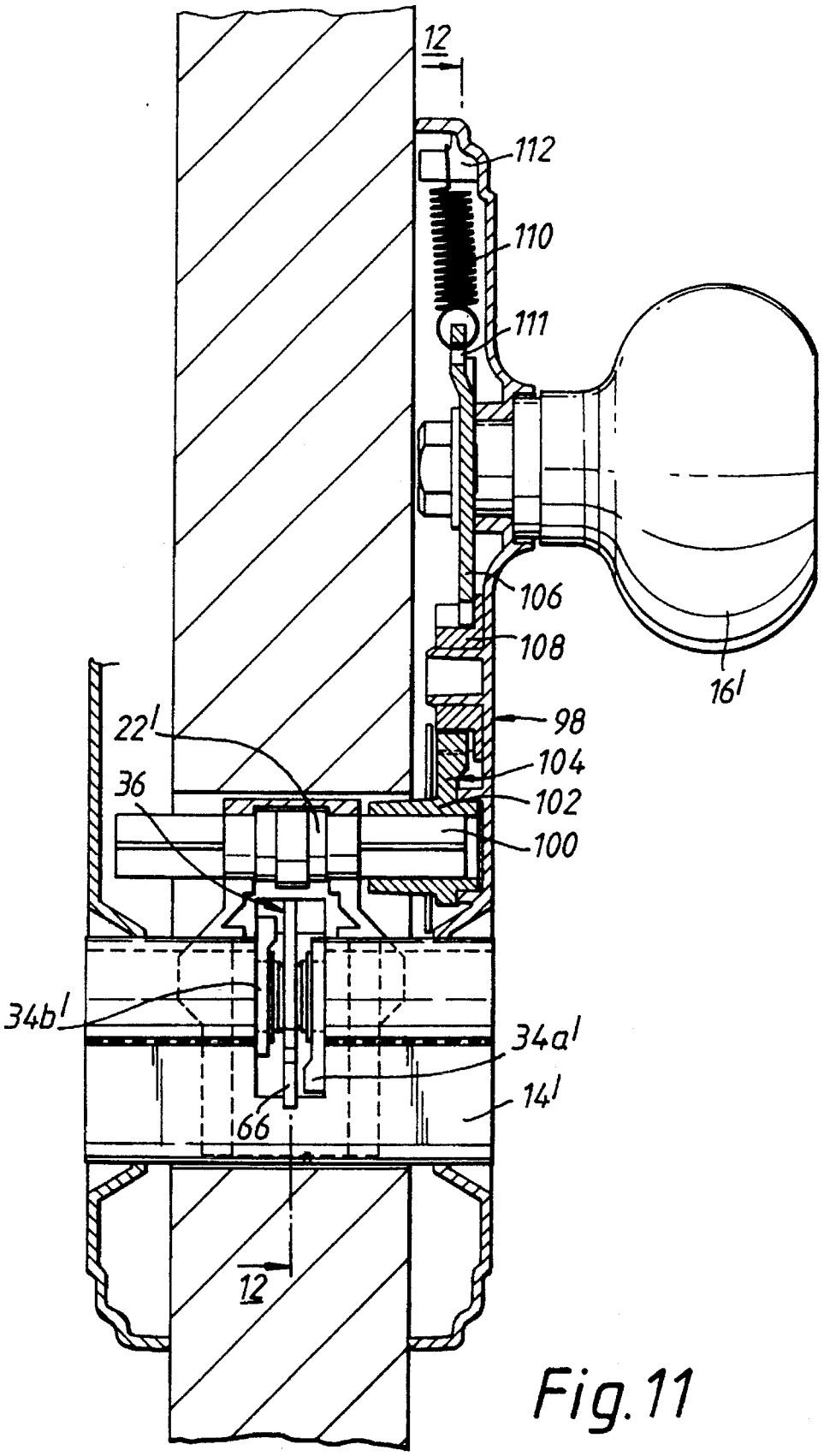
FIG. 11 is a transverse coaxial view of the modified embodiment corresponding to FIG. 3 but showing in detail an alternative manual actuator assembly for withdrawing the latch bolt to its release position.
Figure 12:
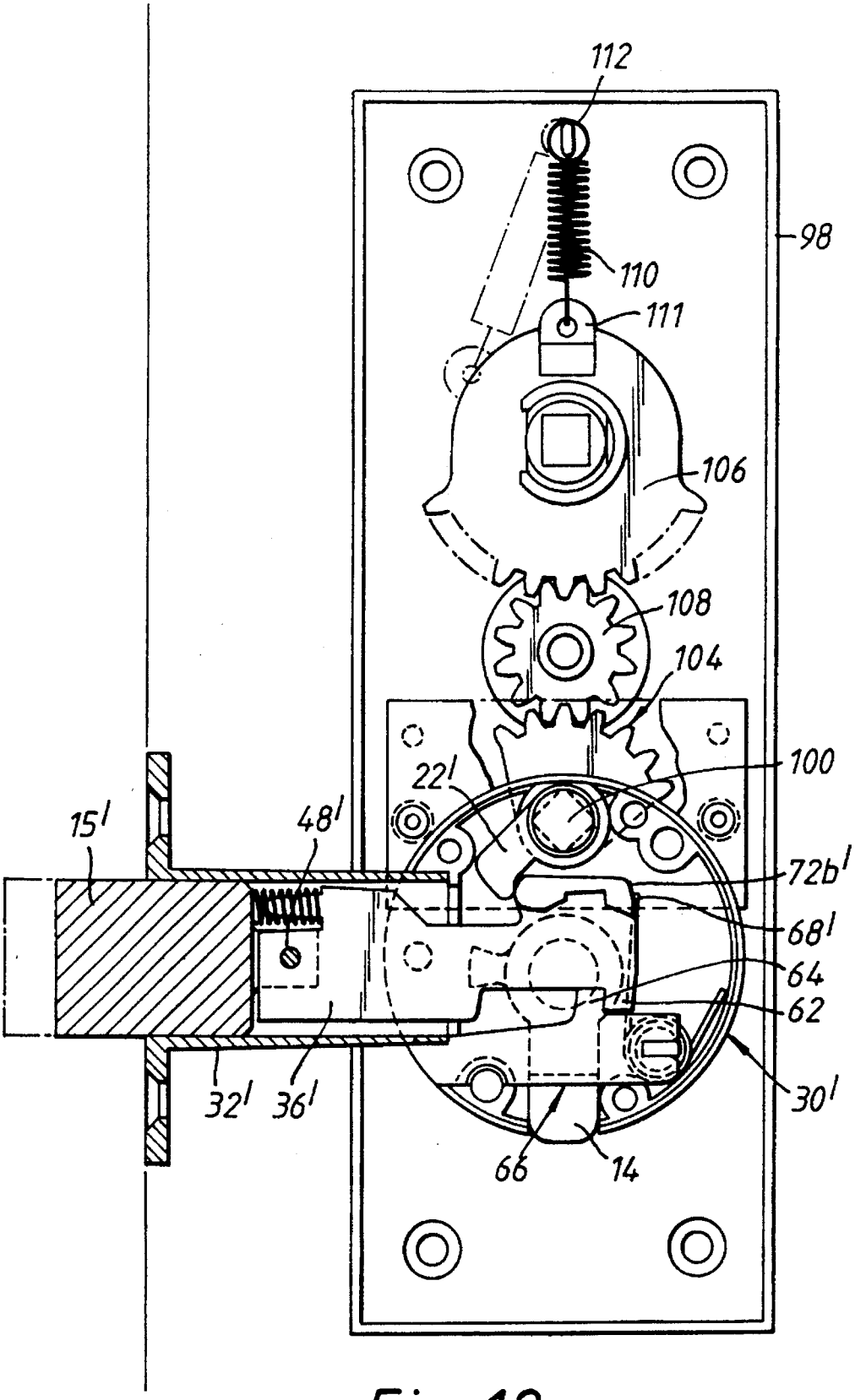
FIG. 12 is a combination cross-section on the line 12—12 in FIG. 11.

Turning to FIGS. 11 and 12, crank 22' is driven by knob 16' via a suitable gear transmission mounted within a cover plate 98 on one side, typically the inside, of the door. Crank 22' is shaped to seat neatly in bight 70 in front of registered noses 74' of lands 72', and thereby to pull the retractor plate back to the release position in a similar fashion to wings 41'. The crank 22' is depicted with a distinct side protrusion 22a but it may be preferable for this protrusion to be a less pronounced shallower convexity of relatively large radius. In that event, the protrusion extends less into bight 70 than illustrated.

Crank 22' is fixed at the centre of a spindle 100 extending across the door and operates between the two winged cam members 34a,34b and so does not obstruct their paths of movement. Spindle 100 is of square section by which it is keyed in the boss 102 of a toothed segment 104. Knob 16' carries a complementary toothed segment 106 and the two segments are drivingly coupled by a pinion 108 rotatably mounted on the inside face of cover plate 98. The knob is biased to a neutral central position by a helical tension spring 110 mounted between a lug 111 at the centre top of toothed segment 106 and a stud 112 at the top of cover plate 98.

It will be seen that the illustrated dual function mechanism is adapted for mounting in a standard cylindrical latch mechanism hole in a door and does not require additional cavity space. The provision of the retractor component as a simple plate facilitates easy manufacture and assembly and in particular avoids the need for a more complex cast component.

Figure 15:
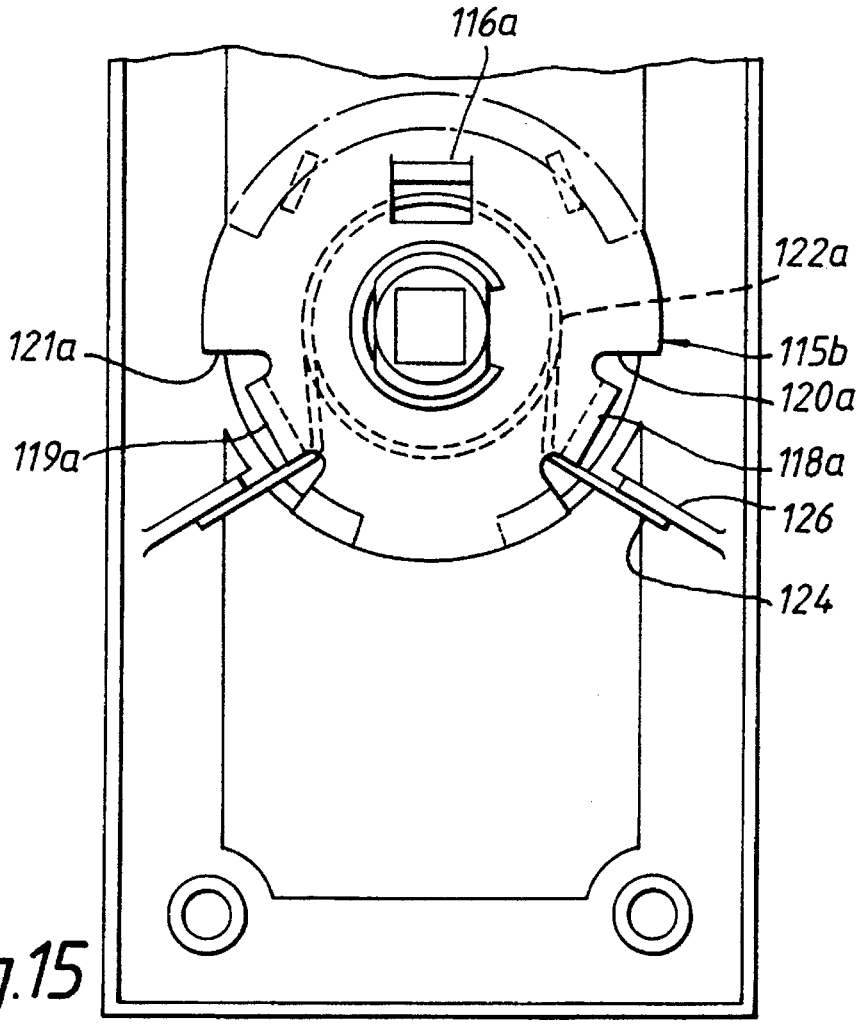
FIG. 15 is a cross-sectional view "X" in FIG. 13.
Figure 13:
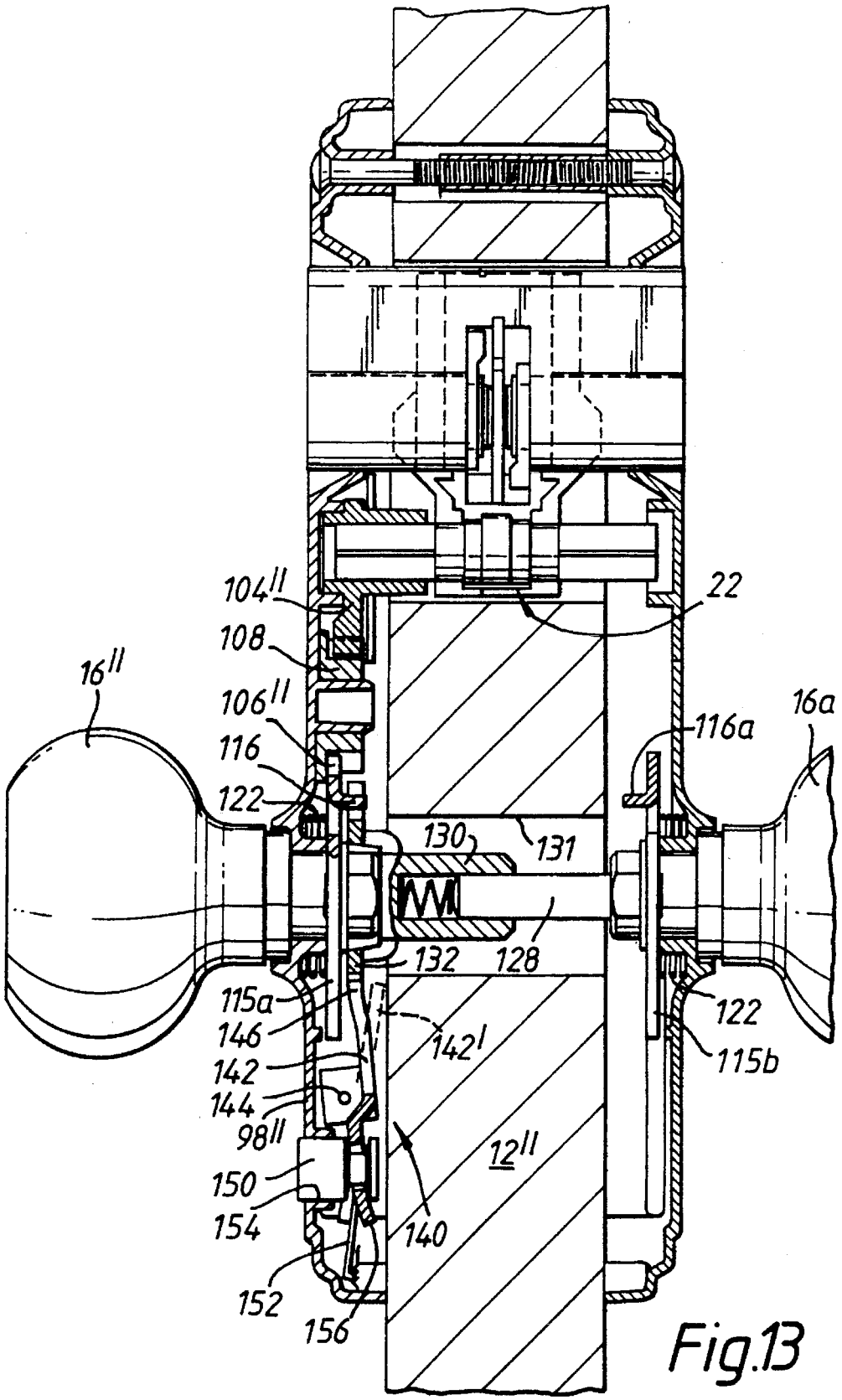
FIGS. 13 and 14 are views similar to FIGS. 11 and 12 but showing a modified manual actuator assembly which incorporates a privacy snib mechanism.
Figure 14:
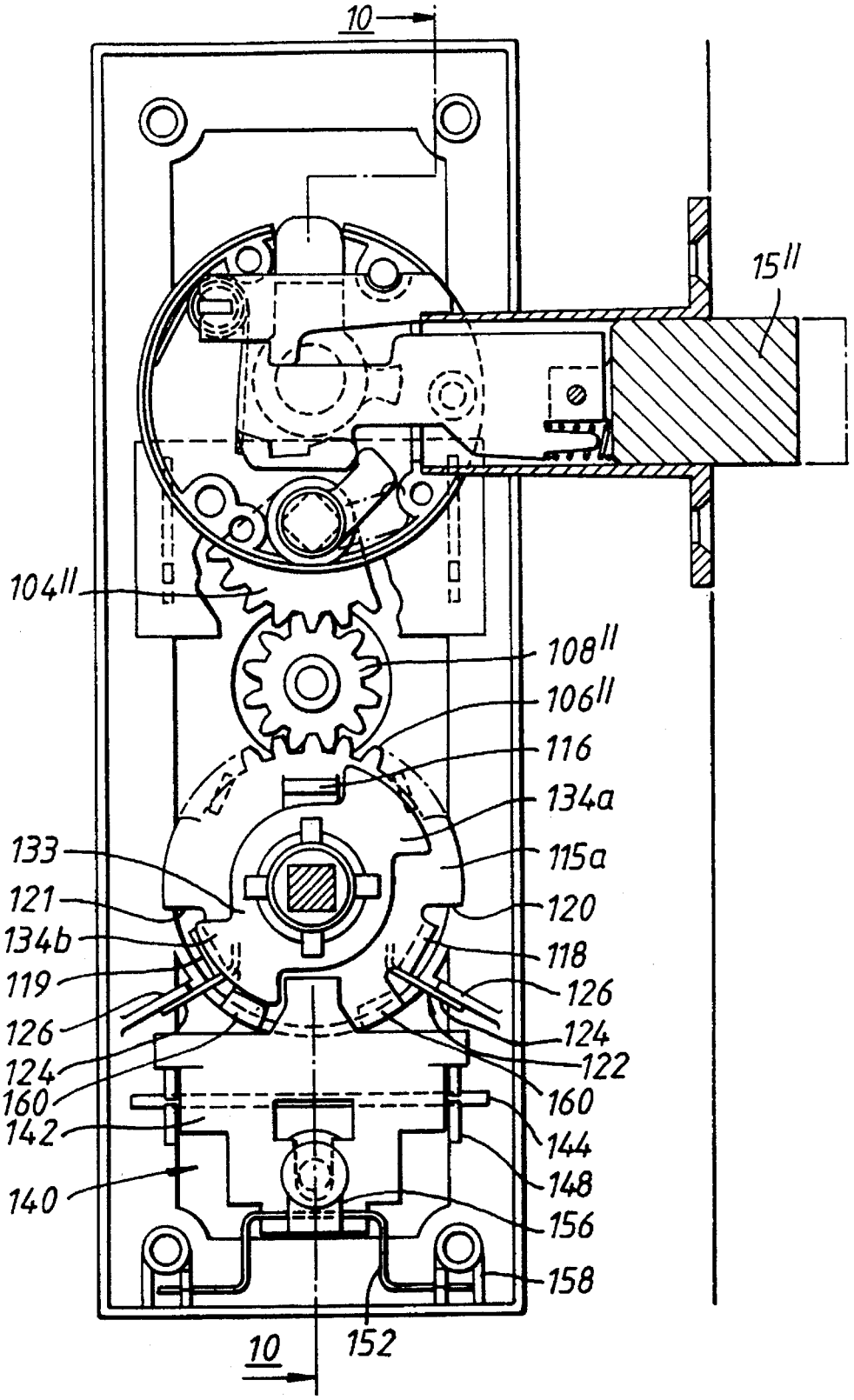
Figure 16:
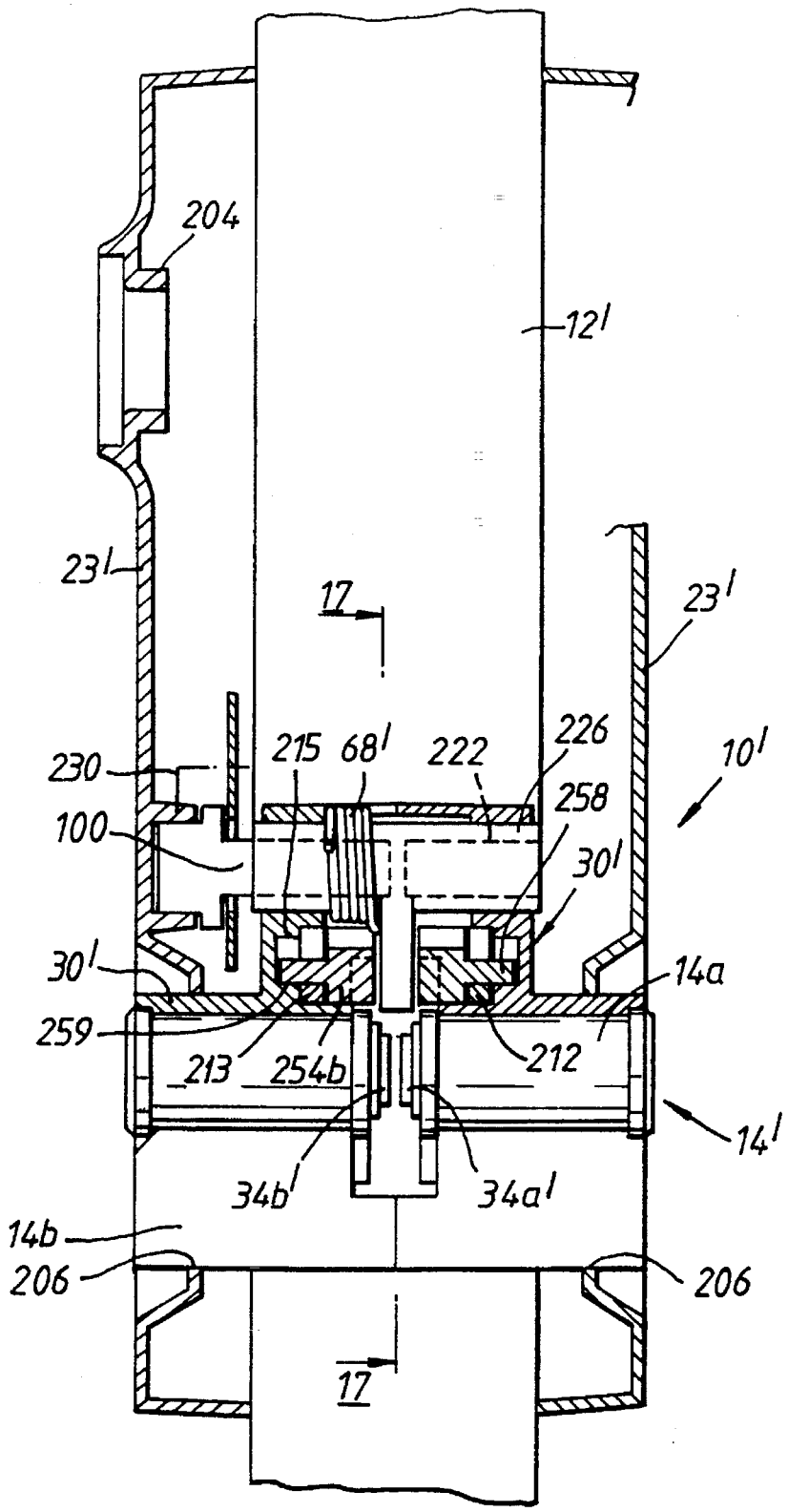
FIG. 16 is a cross-sectional view of a dual function lock assembly including a mechanism comprising a second principal embodiment according to the invention, taken on the vertical plane containing the axes of the two operator spindles.

FIGS. 13 to 15 illustrate a further modification in which the knob 16" is one of a coupled pair of knobs 16",16a which are disposed below rather than above the latch bolt 15" and provide a privacy snib function. Knob 16" is at the inside of the door while knob 16a is at the outside. Inside knob 16" again carries a toothed segment 106" which drives toothed segment 104" via a pinion 108". However, in this embodiment, toothed segment 106" is integrally provided on a rotary member substantially in the form of a drive disc 115a. Drive disc 115a is irrotationally fixed to the square-section spindle of knob 16". The disc has an upper flat lug 116 which projects parallel to the axis of knob 16" towards the door, and is formed by pressing a tab from the disc. Two further lugs 118,119 are pressed angularly the other way, at approximately 4 and 8 o'clock positions on the disc, at the inner rim of peripheral notches 120,121. The outside knob 16a carries a similar drive disc 115b. Instead of tension spring 110, each drive disc 115,115a is biased to a neutral central position, with lug 116 at the top, by a coil spring 122, 122a having terminal end tabs 124 which engage past the respective adjacent end edges of lugs 118,119 to contact aligned limit seats 126.

Knob 16a is coupled to drive disc 115a, and therefore to crank 22, via a spindle extension 128 which irrotationally engages a matching axial socket 130 of a further rotary member 132. Spindle extension 128 and socket 130 extend across bore 131 in the door. Rotary member 132 overlies and is coaxial with drive disc 115*a*. It has a centre disc portion 133 joined to socket 130 by four peripherally spaced frangible links 131. Links 131 are designed to shear break under a predetermined load and will therefore fail if an attempt is made to force the lock by applying a wrench or like device to knob 16*a*.

Rotary member 132 further includes a pair of diagonally opposite peripheral lobes 134 which, in the neutral central position of the knob 116*a*, are disposed with one, 134*a*, having an end edge adjacent an end of lug 116. If outside knob 16*a* is rotated in the appropriate direction, lobe 134*a* of rotary member 132 will normally engage lug 116 and thereby rotate disc 115, thereby driving crank 22. It will be appreciated that knob 16*a* may be readily set during installation to be operable in one or other rotational directions by disposing rotary member 132 with lug 134*a* on the appropriate angular side of lug 116.

Knob 16*a* may be temporarily locked against operation by setting a privacy snib mechanism 140. Snib mechanism 140 includes a shaped snib plate 142 which is pivotable on a longitudinally extending hinge pin 144 between a freeing position (broken lines 142' in FIG. 10) and a snibbing position in which an upstanding lug 146 on the top edge of snib plate 142 lies in the plane of rotary member 132, adjacent the other non-drive lobe 134*b* and diagonally opposite and in lateral dimensional register with lug 116. This relationship is best seen in FIG. 11, from which it will also be appreciated that the rotary member 132 is now locked by lug 146 against operative rotation to engage and move lug 116.

Hinge pin 144 of snib plate 142 extends, between retention posts 148 on the inside of cover plates 98" parallel to the door panel and therefore normally to the common axis of the spindles of the two knobs 16",16*a*. The snib plate 142 is fitted below pin 144 with a press-button 150 for setting the snib plate to the snibbing position, and with a cranked indexing spring 152 for biasing the snib plate to its freeing and snibbing position to either side of a center position. Press-button 150 is exposed through an opening 154 in cover plate 98". Indexing spring 152 is retained at its centre under a deflected tab 156 at the lower end of the snib plate, and at its ends in retention posts 158.

Rotary member 132 may have two pairs of generally opposite lobes 134*a*, 134*b* to minimise free travel at the outside knob.

Disc 115 is configured for automatically freeing snib plate 142 on rotation of knob 16", by virtue of obliquely ramped peripheral cam surfaces 160 adjacent notches 120,121. On rotation of the disc 115, in either direction, one or other of these surfaces 160 engages the root region of lug 146 and automatically pushes the snib plate back about hinge pin 144 to its freeing position.

It will be appreciated that snib mechanism 140 allows an occupant of a house to set latch 15 at its intermediate-throw latch position and snib plate 142 at its snibbing position, thereby achieving a degree of security while inside but allowing movement outside, eg to do gardening, without needing a key, by simply rotating knob 16" to operate crank 22 and so withdraw the latch bolt. This same action automatically frees snib plate 142—so leaving the door unlocked for ready return without a key. On returning inside, the occupant can again ensure a degree of security and privacy, still without a key, by resetting the snib mechanism.

In a further alternative construction, privacy snib mechanism 140 may, instead of comprising a discrete plate 142 and spring 152, be formed as a one piece plate of spring metal of the type which is mounted to snap between the freeing and snibbing positions. Another possible variation is to eliminate the intermediate pinion 108, 108", for example, by enlarging the toothed segments 104, 106 so that they directly mesh.

An alternative principal embodiment of dual function lock mechanism 10' according to the first aspect of the invention is illustrated in FIGS. 16 to 21, in which like primed reference numerals indicate elements which correspond to elements of the embodiments of FIGS. 1 to 15.

Again, the lock assembly 10' is shown mounted to a door leaf 12 and is depicted in somewhat diagrammatic form with some of the detail of external components omitted for sake of clarity. The assembly includes a latchbolt 15', a double cylinder lock 14', having respective cylindrical key locks 14*a*,14*b* operable from the respective sides of the door, and a latch operator mechanism 210 which incorporates a handle shaft 200, linkage 202 and a crank 22'. The assembly is further provided with the usual external facilities such as face plates 23', which define bearings 25 for the latch operator handles (not shown) and lower apertures 206 for the cylinder locks. The usual cavities in the door leaf seat a main body or housing 30' and a latch bolt casing 32'. Housing 30' is a two-part cast assembly enclosing the cylinder locks 14*a*, 14*b*, respective cam members 34*a*', 34*b*' associated with the cylinder locks, a slidable retractor 36' forming a sub-assembly 37' with latchbolt 15', as well as crank 22' forming part of the latch operator mechanism 210.

Latchbolt casing 32' provides a close sliding fit for latchbolt 15' and has an integral external facing plate 33' on the edge of the door. In its latch and lock positions, latchbolt 15' would engage the usual strike plate and cavity (not shown) on the door jamb. Again, the latch bolt has the usual angled face to allow automatic retraction from the latch position when the door is closed.

Retractor 36' comprises a pair of parallel plates 212,213 which are slidable along elongate guideways 214,215 defined by housing 30' at either side of the centre line of the door. These plates 212,213 are joined at rear and front by cross bars 216,217. The front cross bar 217 is enlarged between the plates 212,213 to provide a forwardly projecting socket 218. This socket 218 has a T-section cavity 219 to receive a complementary T-spigot 220 at the rear of latchbolt 15'. The arrangement is such that, prior to assembly, the latchbolt is applied to the socket by introducing the spigot into the cavity at one orientation and then rotating the latchbolt to lock the spigot in the cavity at another orientation. This provides a simple facility for forming assemblies with different latchbolt throws to suit different backsets in situ. The extreme projected limit and retraction limit of the latchbolt are defined by engagement of plates 212,213 at the respective ends of their guideways.

Latch bolt/retractor sub-assembly 37', and accordingly latchbolt 15', have three operating positions: a retracted or release position (FIG. 19) in which the latch bolt is retracted into casing 32' to allow the door to be opened, an intermediate throw latch position (FIG. 20) in which the latchbolt is readily retracted to the release position by simply turning the handle of latch operator mechanism 210, and an extended throw lock position (FIG. 17), a "deadlock" position in which the latch handle is inoperable and in which access is only possible by key actuation of one of the lock cylinders.

Figure 19:
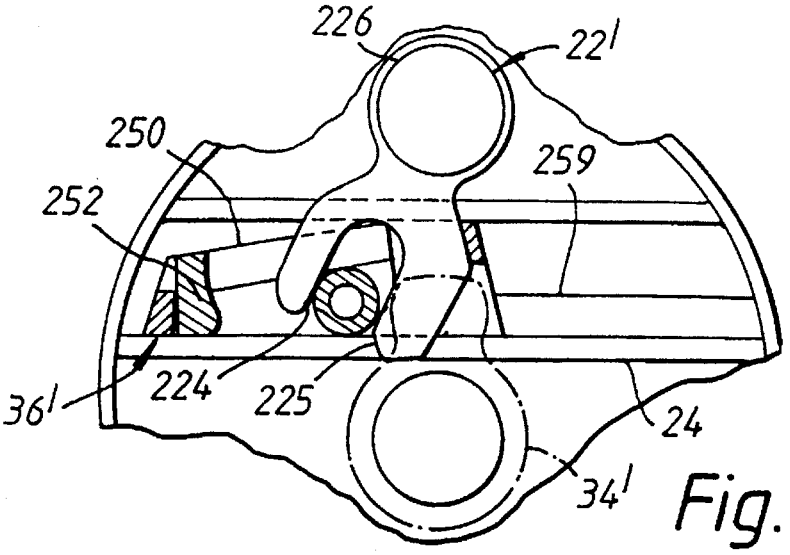
FIGS. 19 to 21 are sketched representations derived from part of FIG. 17 and showing different operational positions of the mechanism.

For operative coupling of retractor 36' to latch operator mechanism 210, the plates 212,213 of the retractor 36' are also joined by a pin 22A which carries a tubular cross-piece 222 forming an integral component of a catch 250, to be described later. Tubular cross-piece 222 is received by a complementary notch 224 at the outer end of the crank 22', which itself projects integrally laterally from cylindrical element 226. Cylindrical element 226 is rotatably journalled in opposed openings in housing 30' and has square section co-axial bores 228, at least one of which thereby irrotationally receives a complementary spindle 100'. This spindle is journalled in turn in a bearing 230 on the inside of one of face plates 23' and is rotatable by the latch handle on shaft 200 via three element linkage 202. Rotation of the handle in the appropriate direction causes crank 22' to rotate in a direction to pull back tubular cross-piece 222 and thereby retract the sub-assembly 37' from the latch position to the release position (FIG. 19). The whole mechanism and sub-assembly is however, biased to the latch position by a coil spring 68' mounted about cylindrical element 226, with its respective ends abutting the inside cylindrical surface of housing 30' and a concave recess 232 formed at the root of crank 22'.

The precise location of the latch position of sub-assembly 37' is determined by catch 250, pivotably mounted on pin 22A of retractor 36'. The primary purpose of this catch is to lock the retractor and latchbolt in the extended throw latch position. Catch member 250 is generally U-shaped, defining a rear cross-piece 252 and respective side arms **254*a*,254*b* which are gently tapered from their free ends to cross-piece 252. Adjacent the lower corner of their free ends, side arms 254*a*,254*b* are also integrally joined by tubular cross-piece 222 by which are they are pivotably secured to the respective plates 212,213 of retractor 36' by means of pin 22A. A small helical compression spring 255 fitted between the upper forward corner of side arm 254*a* and an adjacent land 256 on the respective retractor plate 212,213 (or a coil spring on pin 22A or tubular cross-piece 222) normally biases the catch 250 so that the cross-piece 252 is in front of and in abutment with rear cross-bar 216 of retractor 36'. This biased rotational movement is limited by engagement of respective outside lugs 258 on side arms 254*a*,254*b* with longitudinal ledges 259 in guideways 214,215. Lugs 258 also serve to define the latch position of the retractor/latch bolt assembly 37' by engaging a rear shoulder 280 of a land 282 upstanding from each ledge 259. The lugs 258 are biased against shoulders 280 by coil spring 68', acting via crank 22' and tubular cross-piece 222**.

Figure 17:
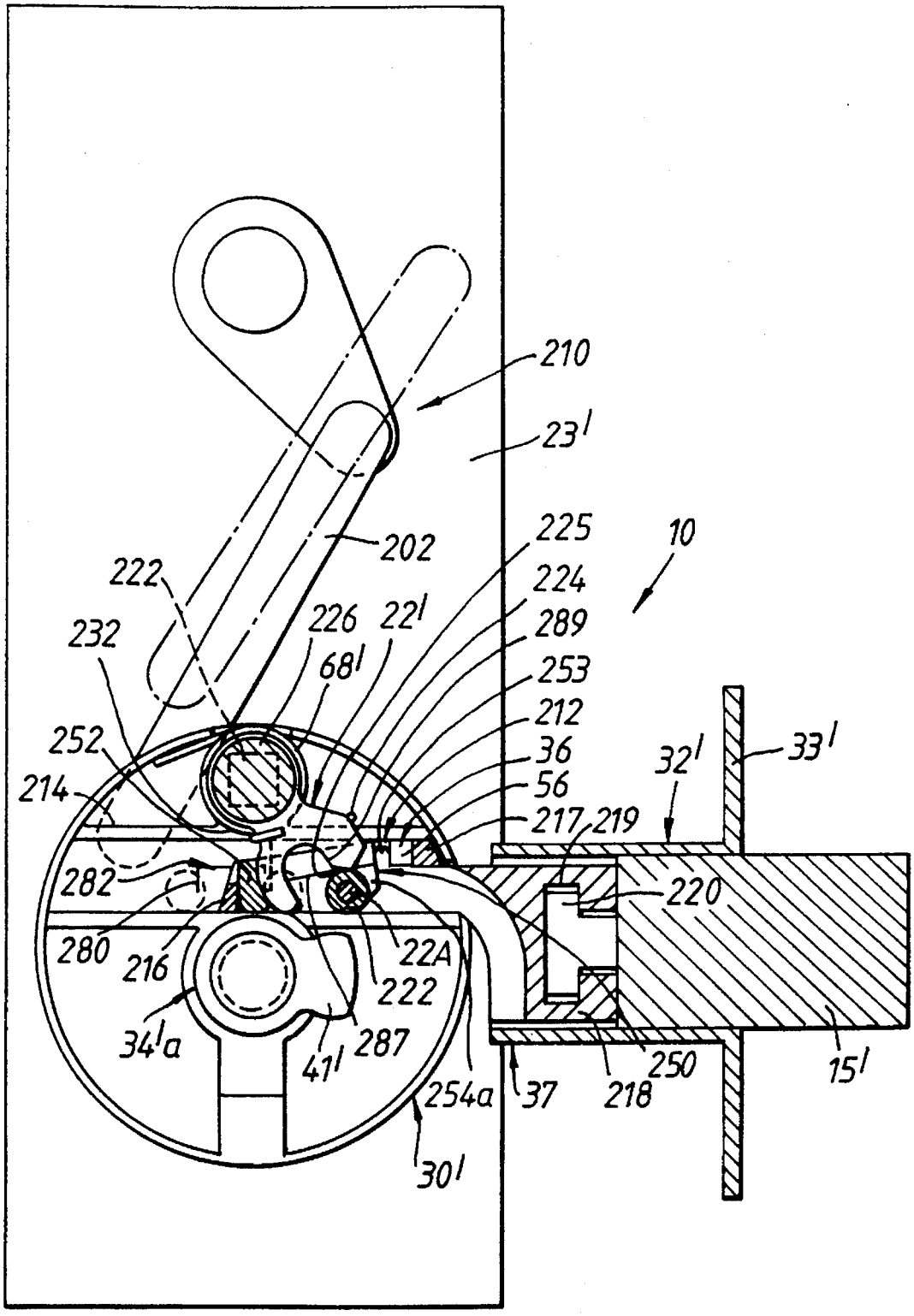
FIG. 17 is a cross-section on the line 17—17 in FIG. 16, depicting the retractor/latchbolt sub-assembly in the lock position.
Figure 18:
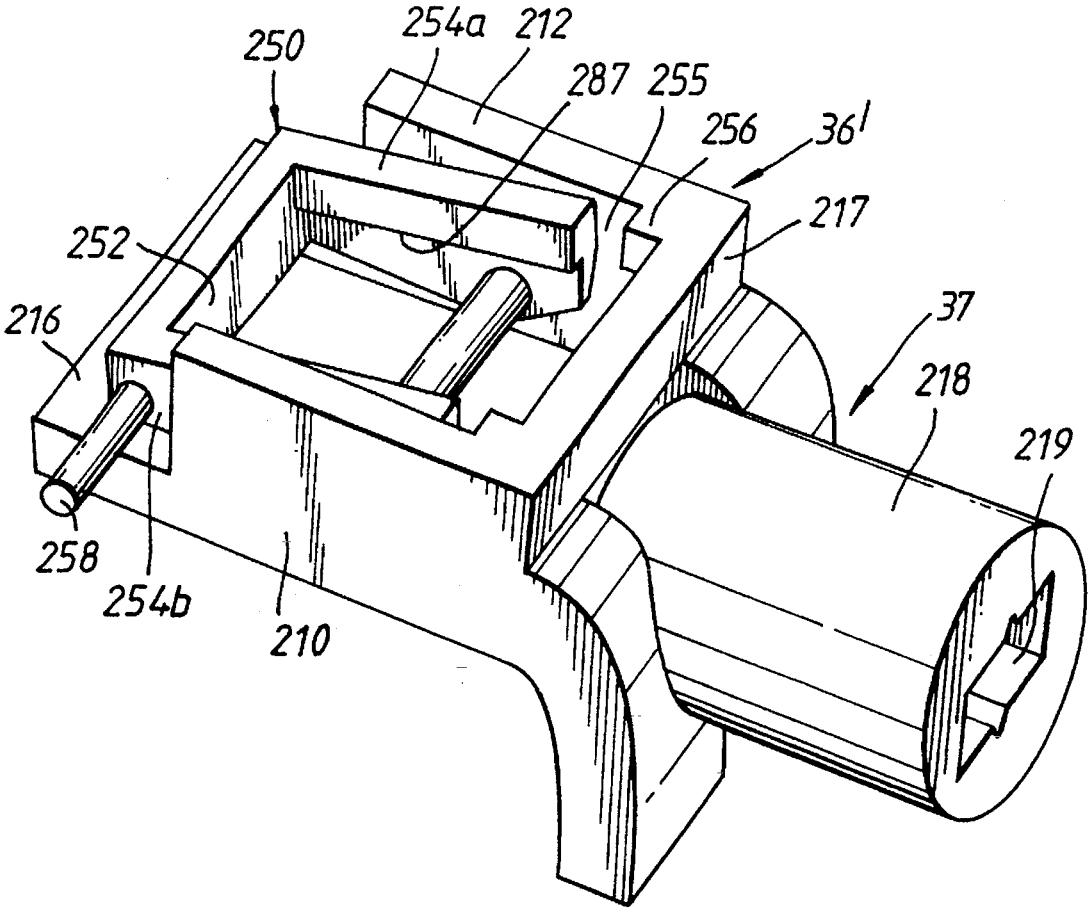
FIG. 18 is an isometric sketch view from above of the retractor and catch.
Figure 20:
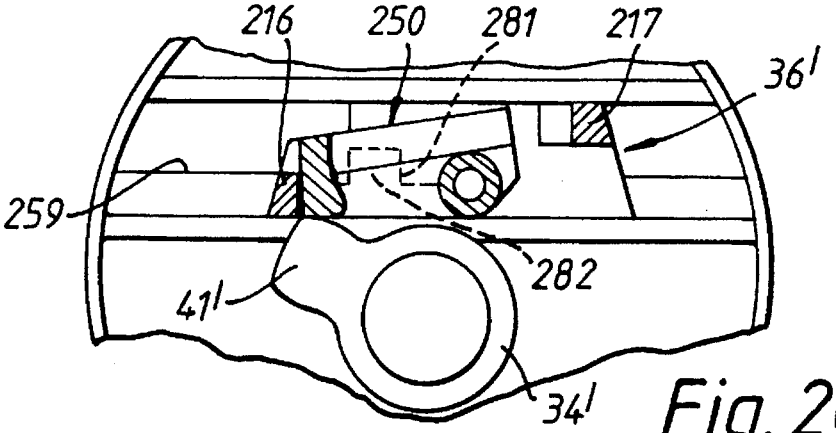
Figure 21:
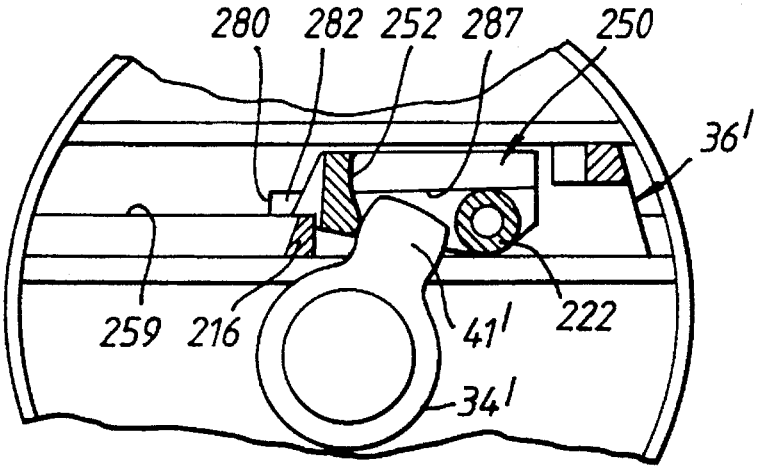

Cam members **34*a*',34*b*' are separately and independently rotatable by means of their cylinder locks 14*a*, 14*b*, and can be employed both to retract the latchbolt from the latch position and to extend the latchbolt to the lock position, as well as reversing the latter setting. Each cam member has a radially projecting wing 41". When the cam member is rotated by the key in one direction (counteclockwise as seen in FIG. 17), the wing will strike tubular cross-piece 222 and by further rotation pull the retractor back against spring 68' to the release position (FIG. 19). When rotated in the other direction, the dimensional arrangements are such that the wing 41' just clears retractor cross-bar 216 and strikes the underside of catch cross-piece 252 (FIG. 20). With further movement, the cam wing lifts the catch (this is dimensionally possible because of the tapered form of catch side arms 254*a*,254*b*) until lug 258 clears land 282 and the cam wing 41' can pass the catch cross-piece and move around to engage tubular cross-piece 222. The catch 250 is held up so that lug 258 is clear of land 282 because the outer rim of cam wing 41' also engages a longitudinal upper inside lip 287 on each of the catch side arms (FIG. 21). Further rotation of the cam member pushes the retractor/latch bolt sub-assembly 37'** to the extended throw lock position.

At this position, the lug 258 of catch 250 passes the forward shoulder 281 (FIG. 20) of land 282 and, because the cam member has now begun to move down past tubular cross-piece 222, the catch suddenly drops in front of retractor cross-bar 216 with lug 258 against shoulder 218. This engagement prevents retraction of the latchbolt by force on the latchbolt. Moreover, because the forward motion of tubular cross-piece 222 has moved crank 22' away from the tubular cross-piece to a position in which a cut-off 225 at a corner of notch 224 rests on top of the cross-piece 222, the crank is locked between the tubular cross-piece and an adjacent pin 289 on the inside face of housing 30'. The latch operator mechanism 16' is therefore inoperable to return the latchbolt from the locked position.

It will be appreciated that, with the latchbolt in the extended throw lock position, the whole assembly has been converted from a simple latch to a deadlock. The deadlock can only be released by key actuating one of the locks to rotate the cam member in a reverse direction past tubular cross-piece 222 against lip 287 to lift the catch so that lug 258 clears shoulder 281. With further movement, the cam wing 41', seated in the rear corner between the lip 287 and the catch cross-piece 252, pushes the cross-piece and therefore the whole retractor sub-assembly rearwardly until the catch is allowed to drop again and engage lug 258 behind land 282. The assembly will now be in the intermediate throw latch position and either a further rotation of the key or operation of the handle will release the latchbolt against spring 68', and thereby open the door.

What is claimed is:

1. A dual function lock mechanism comprising:

a body;

a cam member mounted on the body for rotation about an axis;

retractor means adapted to drive a latch bolt and supported for sliding movement in opposite directions transversely with respect to said axis;

means to slide the retractor means in a first direction of said sliding movement to retract the latch bolt from a latch position to a release position;

respective cooperable mutually engageable formations on the cam member and on the retractor means whereby a predetermined first rotational movement of the cam member is effective to slide the retractor means in a second direction opposite said first direction to move the latch bolt from said latch position to an extended lock position, and a predetermined opposite rotational movement is effective to return the latch bolt from the extended lock position to the latch position; and detent means to engage and thereby normally prevent said retractor means form moving said latch bolt between said extended lock position and said latch position;

wherein said retractor means is so supported and said formations are so cooperable that, to allow movement of said latch bolt from the extended lock position to the latch position, the retractor means is displaceable by the cam member in a direction laterally of said sliding movement whereby to disengage the retractor means from said detent means.

2. A dual function lock mechanism according to claim 1, wherein said retractor means is pivotally attached to a latch bolt or to a latch bolt assembly, whereby said displacement comprises a pivotable movement.

3. A dual function lock mechanism according to claim 1, wherein said retractor means includes plate means.

4. A dual function lock mechanism according to claim 3, wherein there are a pair of said cam members actuable from opposite sides of a door when the lock mechanism is in situ, and wherein said plate means slides between these cam members, there being separate said formations on opposite sides of the plate means operably associated with the respective cam members.

5. A dual function lock mechanism according to claim 3, wherein said plate means comprises a somewhat elongate substantially flat plate.

6. A dual function lock mechanism according to claim 3, wherein said detent means comprises a first lug fixed with respect to said body, said retractor means having a matching second lug which is disposed on respective sides of the first lug in said latch and extended lock positions for the latch bolt.

7. A dual function lock mechanism according to claim 6, wherein said first lug is provided integrally by a plate retained on said body.

8. A dual function lock mechanism according to claim 6, wherein said displacement of the retractor means by the cam member to disengage the retractor means from the detent means is a displacement of the retractor to clear said second lug from said first lug and so allow the second lug to pass the first lug as the retractor means slides between positions.

9. A dual function lock mechanism according to claim 8, wherein said displacement of the retractor means by the cam member to disengage the retractor means from the detent means is a displacement parallel to the plane of the retractor means.

10. A dual function lock mechanism according to claim 1, wherein the retractor means is displaceable by the cam member to disengage the retractor means from the detent means substantially transverse to said sliding movement of the retractor means.

11. A dual function lock mechanism according to claim 1, wherein said cam member includes a radially projecting wing or lug on an annular or disc member.

12. A dual function lock mechanism according to claim 1, wherein said or each formation on said retractor means includes a shaped edge surface engageable by the cam member, which shaped edge surface comprises respective spaced inclined portions engageable by said cam member to displace the retractor means, and an intervening recess to seat the cam member for driving the retractor means in said sliding movement.

13. A dual function lock mechanism according to claim 1, further comprising respective biasing means for biasing the retractor means from the release position to the latch position, and for biasing the retractor means into engagement with the detent means at said latch and lock positions.

14. A dual function lock mechanism according to claim 13, wherein said means for biasing the retractor means into engagement with the detent means at said latch and lock positions comprises a compression spring captive between respective faces on the retractor means and the latch bolt.

15. A dual function lock mechanism according to claim 1, further comprising key actuated lock means, for example a cylinder lock, associated with the cam member.

16. A dual function lock mechanism according to claim 1, wherein said means to slide the retractor means in said first direction of said sliding movement to retract the latch bolt from the latch position to the release position comprises a latch operator mechanism including a hand operator on a separate spindle from that or those mounting the cam member, which latch operator mechanism includes a crank with a recess or seat which receives an element of the retractor means, wherein that element and the crank are not operably engageable in the lock position of the latch bolt.

17. A dual function lock mechanism according to claim 16, fitted to a door whereby the hand operator and a key lock associated a said cam member are exposed to the interior of the door, while at the exterior there is a second key lock associated with another said cam member.

* * * * *